US008132360B2

(12) United States Patent
Jin et al.

(10) Patent No.: US 8,132,360 B2
(45) Date of Patent: Mar. 13, 2012

(54) SELF-WATERING AND ROTATING CHRISTMAS TREE STAND

(75) Inventors: Samuel Zhihui Jin, Hacienda Heights, CA (US); Joseph Robert Adamski, Pasadena, CA (US)

(73) Assignee: Samuel Zhihui Jin, Hacienda Height, CA (US)

( * ) Notice: Subject to any disclaimer, the term of this patent is extended or adjusted under 35 U.S.C. 154(b) by 58 days.

(21) Appl. No.: 12/854,673

(22) Filed: Aug. 11, 2010

(65) Prior Publication Data

US 2012/0036770 A1 Feb. 16, 2012

(51) Int. Cl.
*A47G 7/02* (2006.01)
*A47G 33/12* (2006.01)

(52) U.S. Cl. ..... 47/40.5

(58) Field of Classification Search ..... 47/40.5; 248/522, 523, 524, 525
See application file for complete search history.

(56) References Cited

U.S. PATENT DOCUMENTS 2,416,802 A * 3/1947 Roung ..... 47/40.5
2,587,788 A * 3/1952 Tacy ..... 248/522
2,674,147 A * 4/1954 Franklin ..... 84/95.1
2,847,175 A * 8/1958 Farley et al. ..... 47/40.5
5,054,236 A 10/1991 Sands
5,076,009 A 12/1991 Ciber
5,522,179 A 6/1996 Hollis
5,551,659 A * 9/1996 Sofy ..... 248/523
5,921,022 A * 7/1999 Baker ..... 47/40.5
5,979,859 A * 11/1999 Vartanov et al. ..... 248/522
6,128,854 A 10/2000 Chaney
6,320,327 B1 11/2001 Lavatelli et al.
6,739,566 B1 5/2004 Kao
6,868,754 B2 3/2005 Eix
6,966,334 B2 11/2005 Bolster
7,021,598 B2 4/2006 Kao

OTHER PUBLICATIONS

U.S. Appl. No. 61/275,271, filed Aug. 28, 2009, Sanuel Z. Jin; Joseph R. Adamski.

* cited by examiner

*Primary Examiner* — Monica Williams
(74) *Attorney, Agent, or Firm* — Pujie Zheng; Law Offices of Pujie Zheng

(57) ABSTRACT

The present invention provides a Christmas tree stand that is self-watering and rotatable. The self-watering system, that rotates with the tree, mainly includes a water reservoir, a hose, a water tank that holds on to the lower end of the tree, and a valve mechanism that automatically keeps the water in the water tank at optimum level. A rotatable tank assembly is driven by an electric drive motor on a stationary support assembly. Electrical power is passed from the stationary support assembly to the rotatable tank assembly through a slipping-ring connector. In the preferred embodiment, a remote control is provided to supply power for rotation of the rotatable tank assembly, including the tree, and the power receptacle on the rotatable tank assembly for suitable electrical loads, e.g., decorative lights, separately.

13 Claims, 10 Drawing Sheets

SELF-WATERING AND ROTATING CHRISTMAS TREE STAND

FIELD OF THE INVENTION

The present invention relates to a support stand for a plant such as a Christmas tree, and more specifically relates to a support that is rotatable, that has a self-watering system, and that passes the power from the stationary support assembly to the rotatable tank assembly to supply power to the rotatable portion such as decorative lights.

BACKGROUND OF THE INVENTION

It has been a challenge to keep Christmas trees alive from the time period starting before Christmas and often ending well after New Year's Day. Many attempts have been made and many patents issued to solve that problem. The design for a rotatable Christmas tree stand presents further challenges to inventors.

U.S. Pat. Nos. 5,979,859 and 6,320,327 requires a slow speed motor, which is less available than a faster motor. U.S. Pat. Nos. 6,128,854, 6,739,566, 6,868,754 and 7021598 solve the problem with speed reduction gear systems to reduce the rate of rotation of a fast motor to a more desirable, i.e., lower, speed.

In order for the rotational motion and energy of the motor positioned in the stationary support assembly to be used to rotate the tree, various bearing systems have been designed (e.g., U.S. Pat. Nos. 5,979,859, 6,320,327, 6,128,854, 6,739, 566, 6,868,754 and 7,021,598). The challenge is for a small stand to bear the weight of a heavy tree. The present invention, with its structure and the support gear, is especially effective in weight bearing.

A water supplying system is required for live Christmas trees to keep the tree fresh for a few weeks. There are essentially two types of watering systems, one that allows people to inject water directly to the tank (U.S. Pat. No. 5,979,859), and the other that allows a reservoir to feed water to the tank automatically (U.S. Pat. Nos. 5,054,236, 5,076,009, 5,201, 140, 5,522,179 and 6,966,334).

The combination of watering and rotating (e.g., U.S. Pat. No. 5,979,859) has also been attempted. However, previous approaches lack full functionality. For instance, U.S. Pat. No. 5,979,859 lacks the automatic water level control.

SUMMARY OF THE INVENTION

In the present invention, an electric drive motor fastened to a stationary support assembly rotates the rotatable tank assembly with means to hold on to the tree. A float valve assembly in an automatic watering system keeps the water in a water tank to the optimum level. The rotatable tank assembly is supported by a support bearing. Electricity is passed from the stationary support assembly to the rotatable tank assembly by a slipping-ring connector located at the bottom of the rotatable tank assembly to supply power to the tree, e.g., decorative lights. A remote control is implemented in the preferred embodiment to control separately the power supply to the electric drive motor and the stationary support assembly. Soluble fertilizers may be added the reservoir to further extend the freshness of the tree.

DETAILED DESCRIPTION OF THE INVENTION

Figure 1:
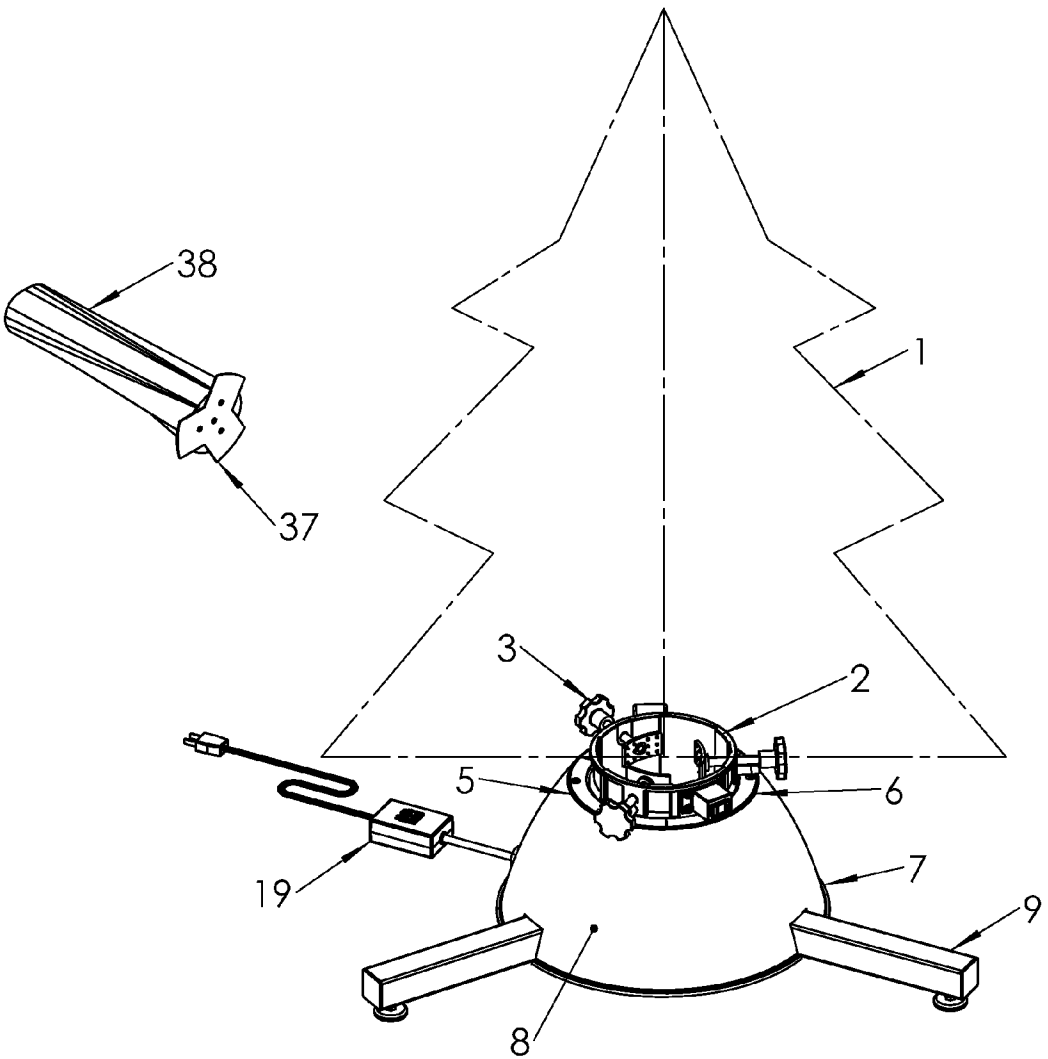
FIG. 1 The general view
FIG. 2 The bearing

FIG. 1 shows the general view of a Christmas tree 1 being held onto a rotatable tank assembly 2. A plurality of knob-grippers 3 (see also FIG. 5 and FIG. 6) on top and a Y-shaped plate 37 fastened to the flat cut bottom of the tree section 38 serve to position the tree securely and upright in rotatable tank assembly 2. At the end of each threaded knob-gripper 3 is rotatably attached a curved studded plate 4 (see also FIG. 5 and FIG. 6), designed to substantially match the curvature of a typical Christmas tree trunk, and suitably weighted so as to cause it to be aligned to the axis of the tree truck, even when not in contact with the trunk. The force created by the knob-grippers is transmitted through the gravity aligned curved studded plate, causing the plate to bite into the tree trunk and create a positive, non-slip clamp to retain the heavy, large diameter tree in a substantially upright orientation. The rotatable tank assembly 2 is supported by a support bearing 5, which is on the top of a support framework 6, to a stationary support assembly 7. The rotatable tank assembly 2 on the stationary support assembly 7 is shielded by a protective cover 8 and supported by a plurality of outwardly extending legs 9. The Y-shaped plate 37 is fastened to the bottom of the tree section 38 using common wood screws or nails and serves to locate the tree substantially centered in the rotatable tank assembly 2 by adjustment of the knob-grippers 3.

Figure 2:
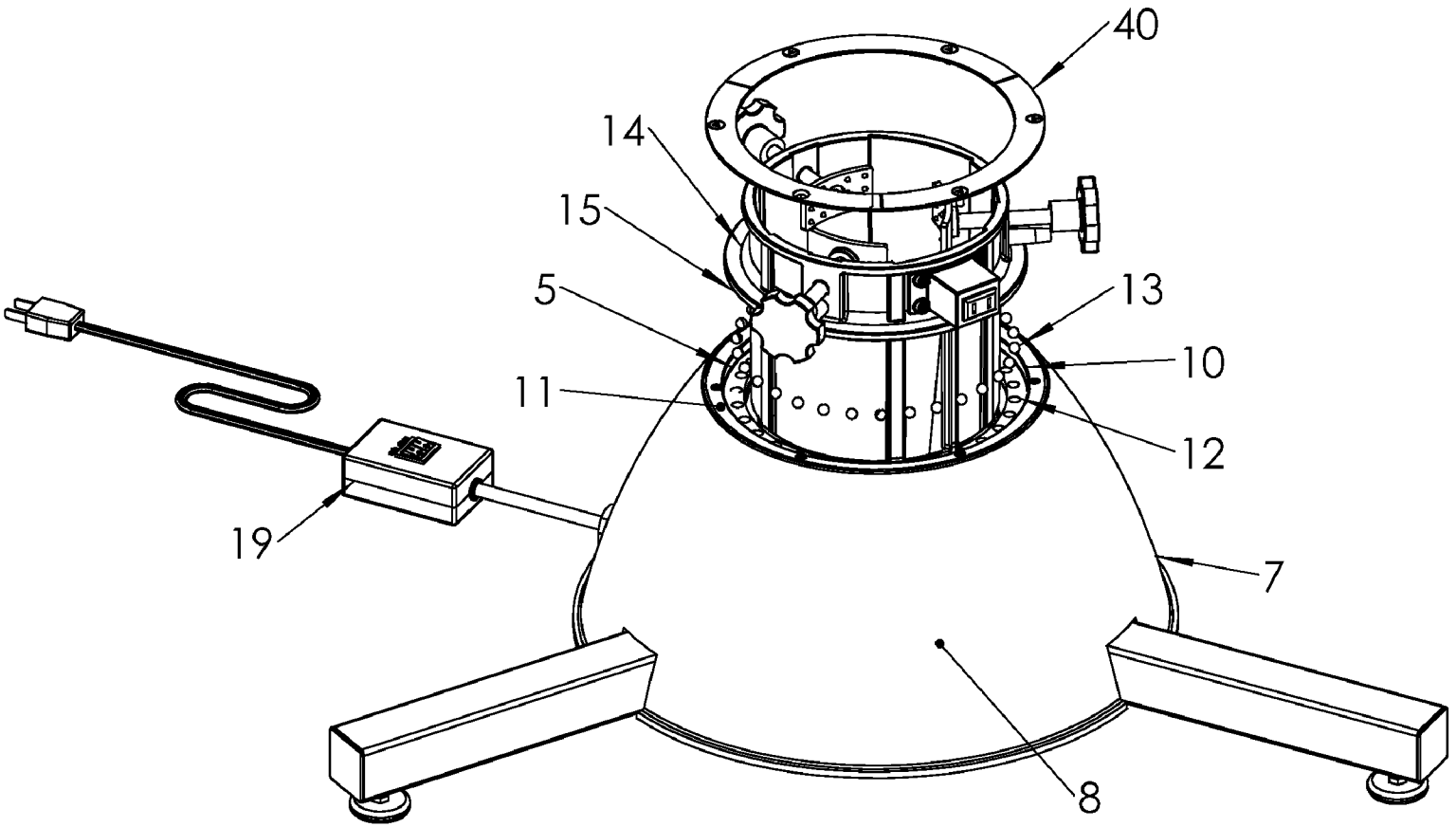

Referring now to FIG. 2, a bearing race 10 is used to support the rotatable tank assembly 2 on the stationary support assembly 7. On the stationary side 11 of the support bearing 5, a plurality of recesses 12 are made for metal balls 13 to be situated and rotate freely. On the moving side 14 of the support bearing 5, a race 15 allows the balls to rotate freely in their respective recesses and thereby rides on the rotating surface of the non-translating ball. The support bearing holds the entire weight of the Christmas tree 1 and the rotatable tank assembly 2. Holding ring 40 retains the rotatable tank assembly to the stationary support assembly.

Figure 3:
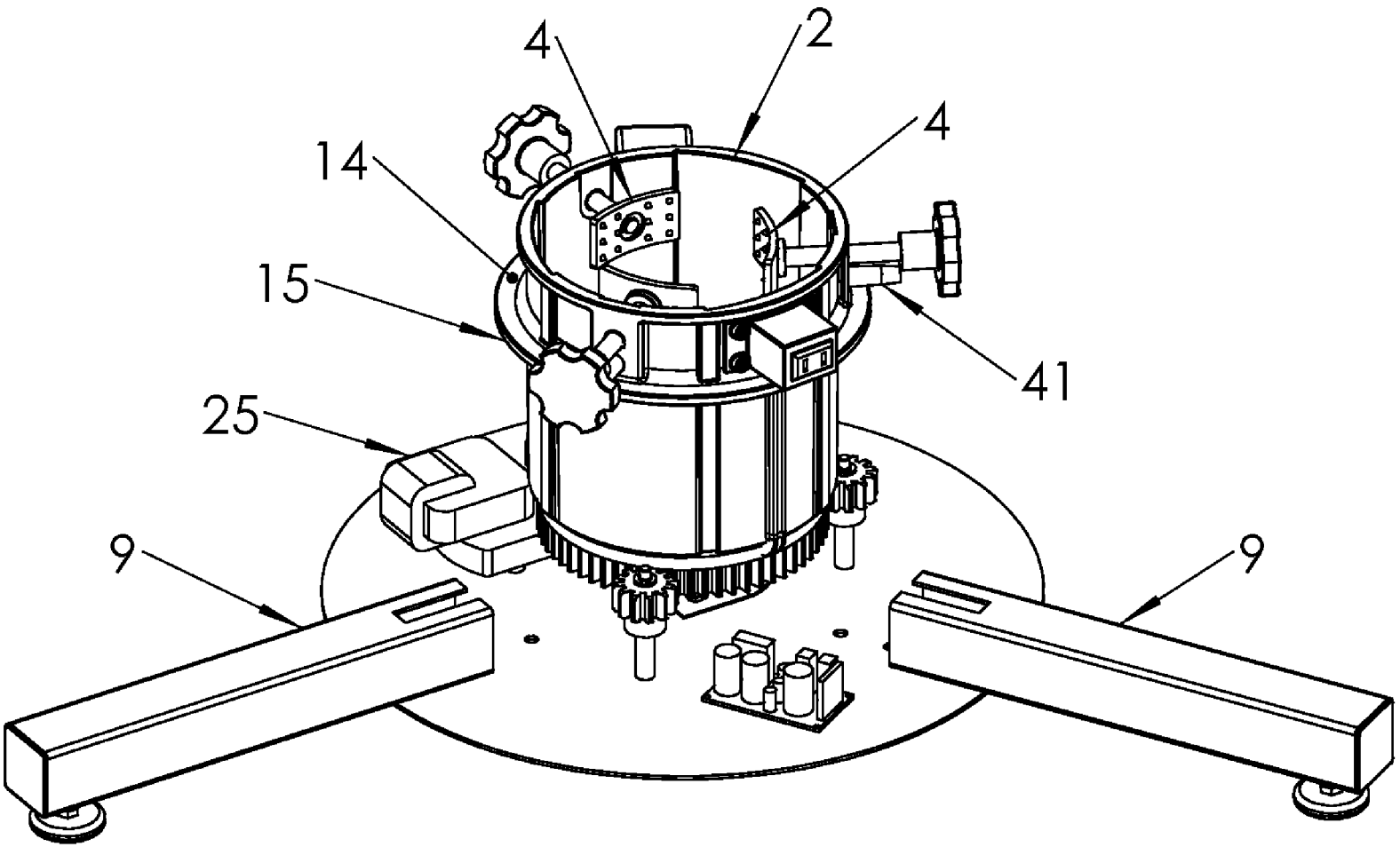
FIG. 3 The stand without the protective cover
FIG. 4 The stationary support assembly without the rotatable tank assembly installed
FIG. 5 The rotatable tank assembly (top view)
FIG. 6 The rotatable tank assembly (bottom view)
FIG. 7 The electric drive motor and the gears
FIG. 8 The automatic watering system
FIG. 9 The float valve assembly
FIG. 10 The exploded view of the stand
Figure 4:
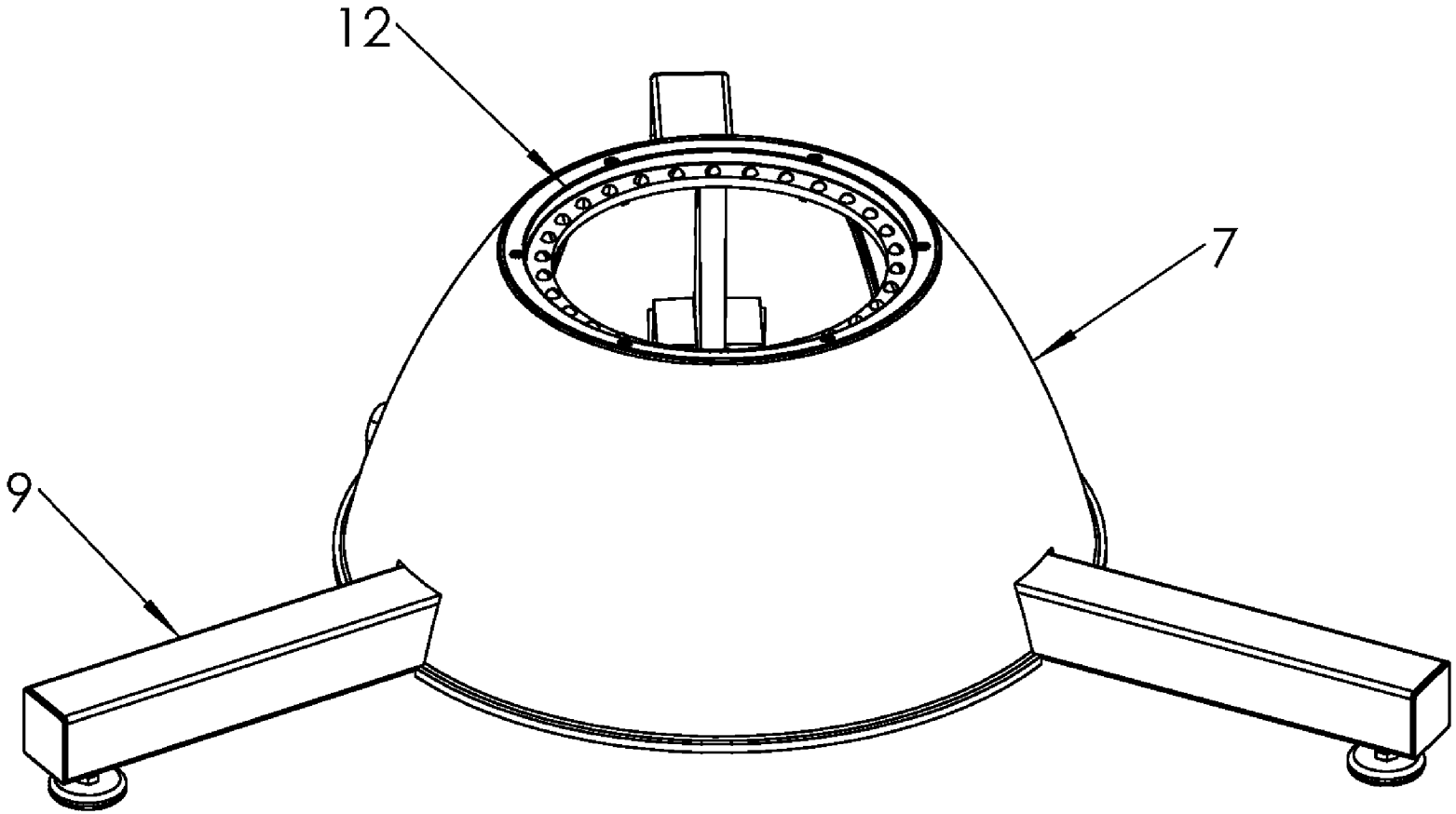

FIG. 3 shows the stand without the protective cover 8. FIG. 4 shows the stationary support assembly 7 without the rotatable tank assembly 2. Overflow channels 41 (FIG. 3) allow excess water present in the rotatable tank assembly 2 to be directed beyond the holding ring 40 (FIG. 2) thereby reducing the possibility of water entering the stationary support assembly through the support bearing 5.

Figure 5:
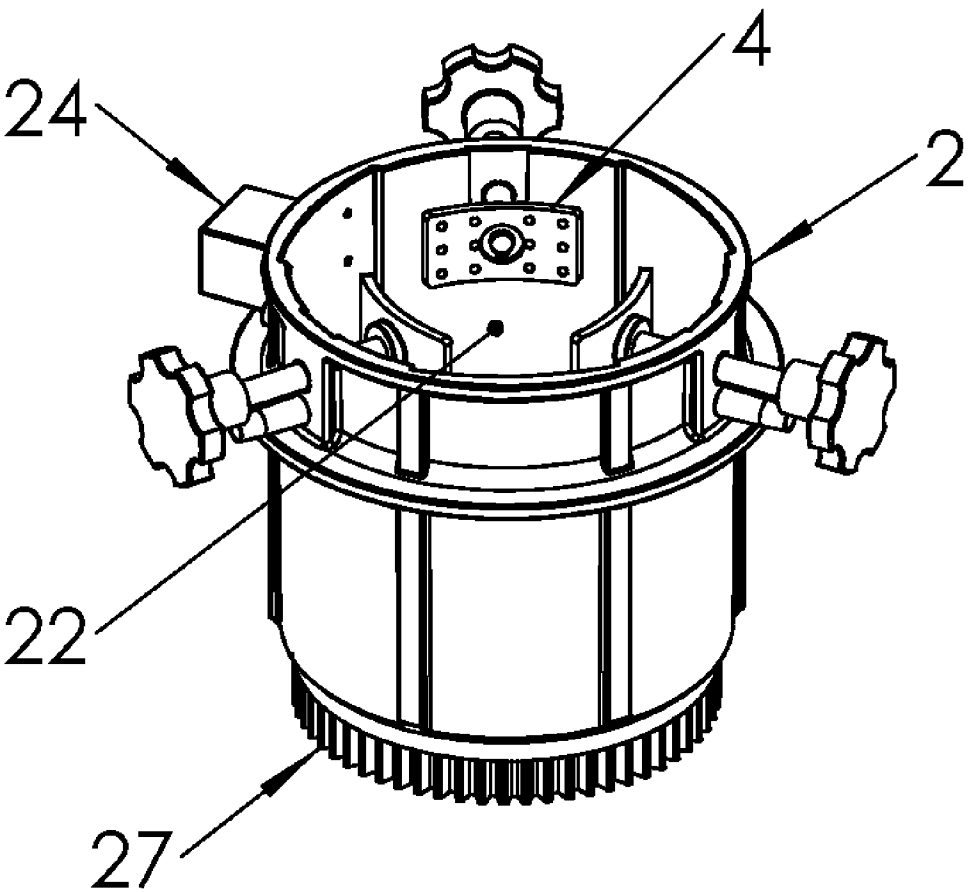
Figure 6:
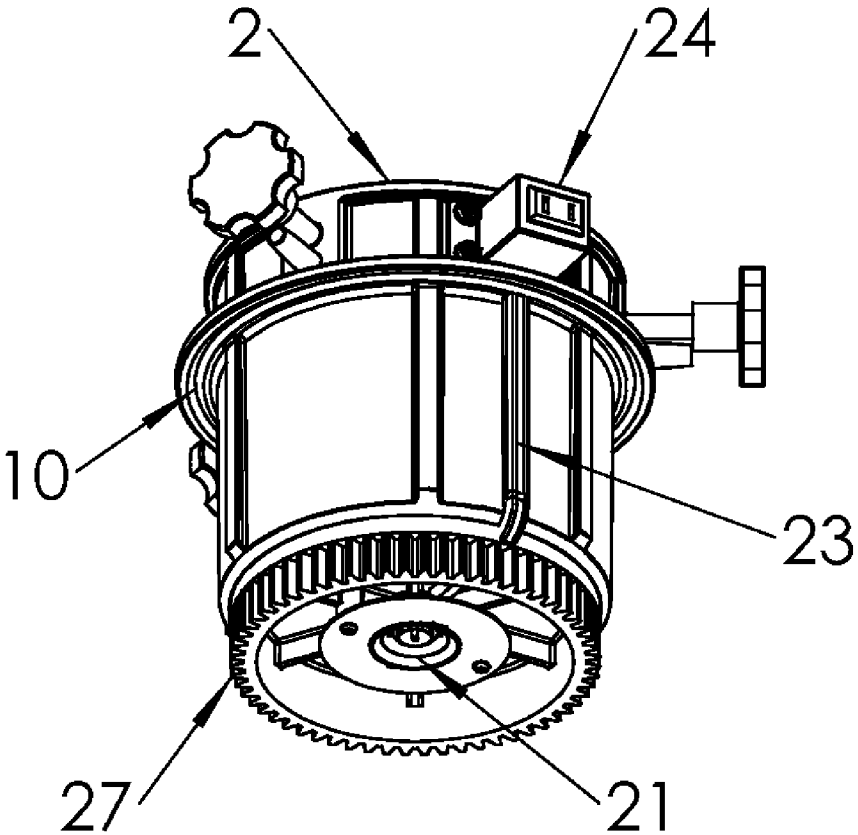
Figure 7:
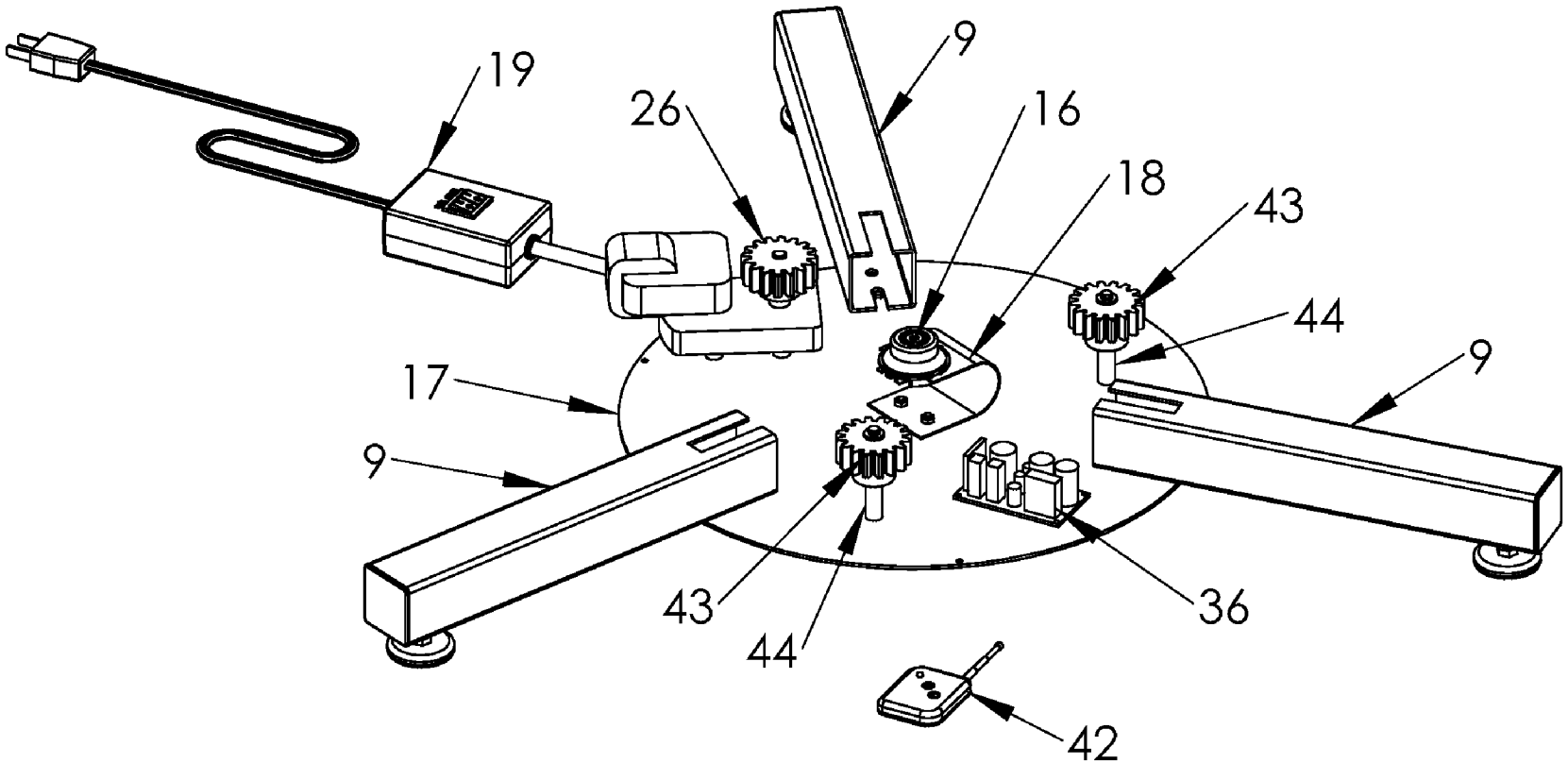

FIG. 5 and FIG. 6 shows the rotatable tank assembly 2. FIG. 7 shows the stationary support assembly 6. Electricity is transmitted from the stationary support assembly 7 to the rotatable tank assembly 2 through a slipping-ring connector. The receiving-side slipping-ring connector 21 (FIG. 6), located at the center of the bottom of the water tank 22, is connected to the sending-side slipping-ring connector 16 (FIG. 7), which is fastened to the stationary support assembly 6 base 17 (FIG. 7) by a bracket 18 (FIG. 7) and connected to a power switch box 19 (FIG. 7) by stationary cable 20 (FIG. 7). A rotating cable 23 further passes the electrical power from the receiving-side slipping-ring connector 21 to a power receptacle 24. Power receptacle 24 supplies power to decorations on the tree, such as lights.

FIG. 7 shows an electric drive motor 25, fastened to the base 17 and driving a small drive-gear 26, which is also fastened to the base 17. The small drive-gear 26 drives a tank gear 27 (FIG. 5 and FIG. 6) integrated into the bottom of the water tank 22. Idler gears 43 are positioned on stationary support shaft 44 attached to base 17 and provide resistance to torque imbalance caused by an improperly installed tree.

Figure 8:
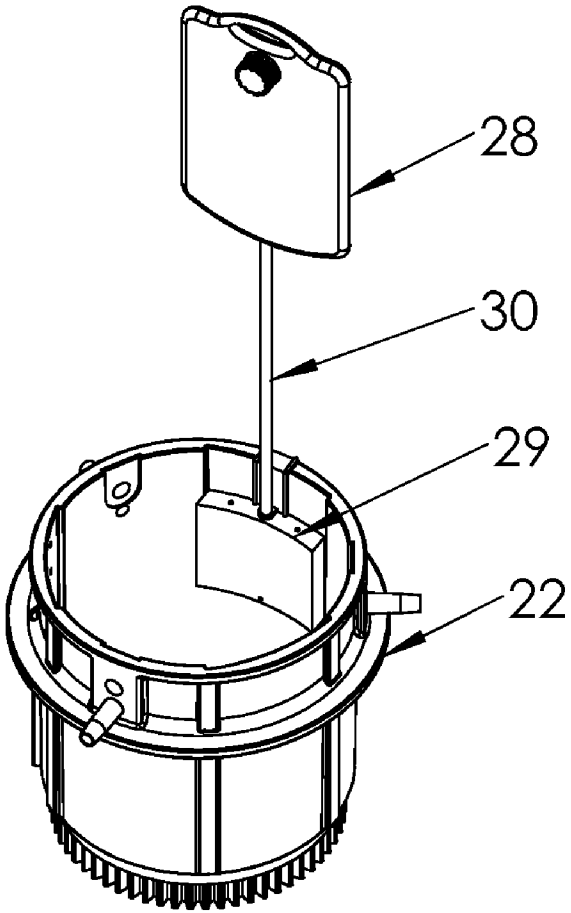
Figure 9:
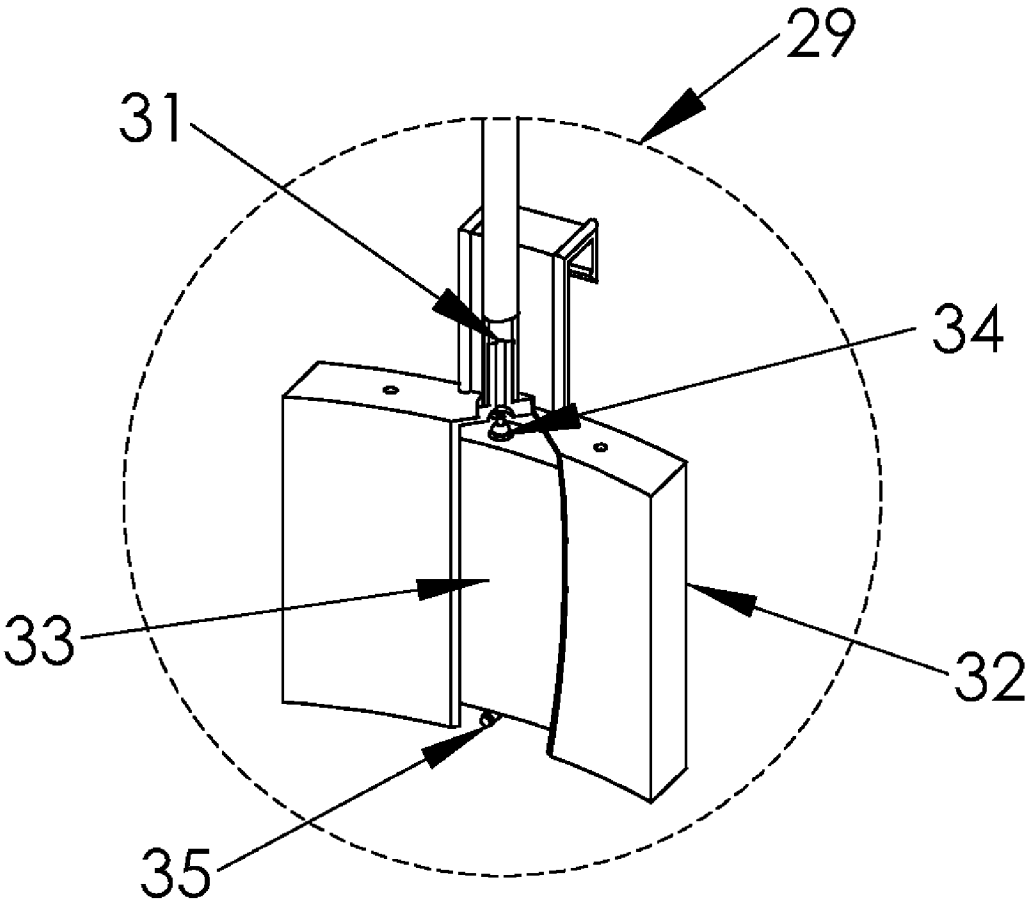

FIG. 8 and FIG. 9 shows the automatic watering system that supplies water to the water tank 22. It comprises a water reservoir 28, a float valve assembly 29, and a hose 30 that connects the water reservoir 28 and top of water inlet 31 on the float valve assembly 29. The float valve assembly 29 is seated on the inside of the water tank 22 and comprises a body 32 and a float 33 inside the body. When water level pushes the float 33 up, a float plug 34 on the top of the float 33 will plug into the bottom of water inlet 31 thereby stopping the flow of water. A holding pin 35 stops the float from falling out of the body.

Figure 10:
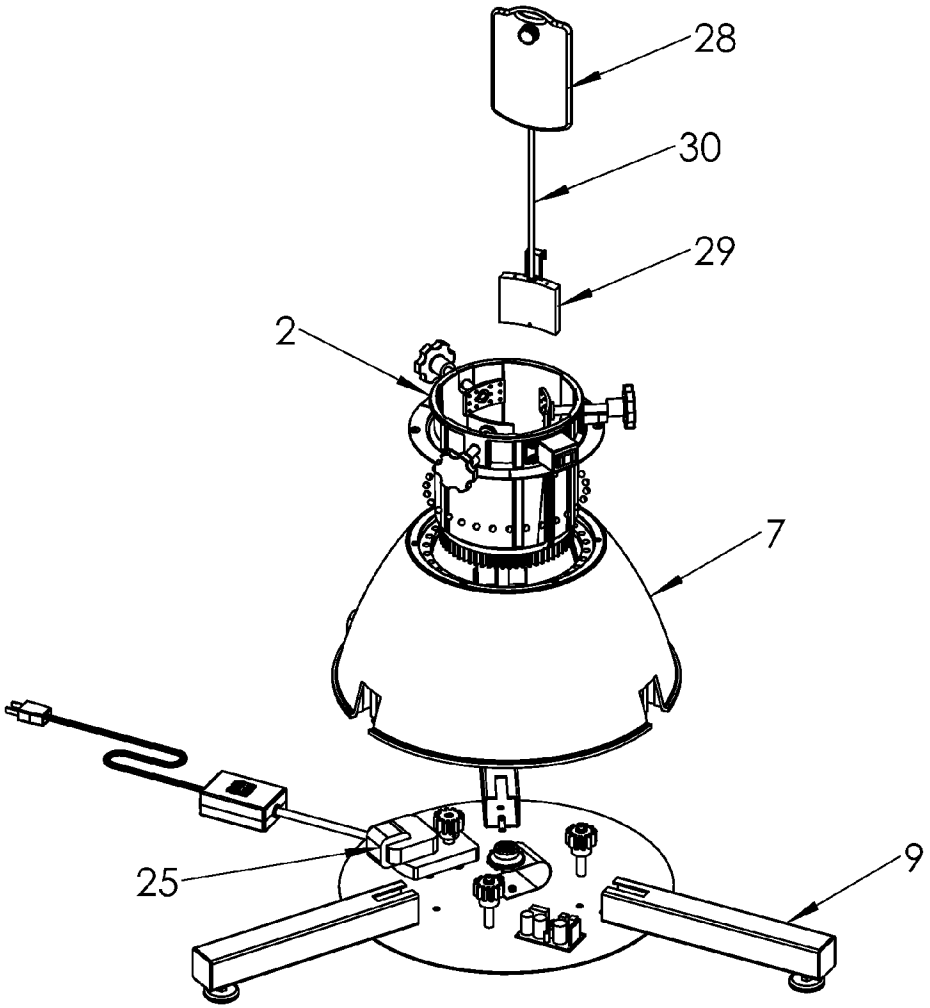

FIG. 10 is the exploded view of the stand.

In the preferred embodiment, the water reservoir 28 and the hose 30 may be colored to blend in with the color of the tree. Soluble fertilizers may be added to the reservoir 28 to fertilize the tree.

As shown in FIG. 7, the power switch box 19 has two switches, one controlling the power supply to the electric drive motor and the other controlling the power receptacle 24 (FIG. 5 and FIG. 6) on the rotatable tank assembly 2 (FIG. 5 and FIG. 6). A remote-control transmitting device 42 sends control commands to receiving device 36 thereby controlling power supply to the gear motor 25 and power receptacle 24, separately.

What is claimed is:

1. A self-watering and rotating Christmas tree stand comprising:

a stationary support assembly, a rotatable tank assembly rotatably supported on said stationary support assembly, and an automatic watering system, with said stationary support assembly comprising a plurality of outwardly extending legs, a support framework, a support bearing to support said rotatable tank assembly, a sending-side slipping-ring connector to conduct electricity to said rotatable tank assembly, and an electric drive motor;

said rotatable tank assembly comprising a water tank, a mechanism to affix the tree to said water tank, a bearing race that matches said support bearing on said stationary support assembly and allows said rotatable tank assembly to rotate freely on said stationary support assembly, a receiving-side slipping-ring connector to receive electricity from said stationary support assembly, a power receptacle, electricity conducting cables connecting said receiving-side slipping-ring connector and said power receptacle, and a tank gear integrated into the bottom of said water tank;

said automatic watering system comprising a water reservoir, a hose, and a float valve assembly;

said float valve assembly comprising a float and a body, which is a shell enclosing said float;

said float has a float plug on the top;

said body comprising a water inlet at the top and a pin at the bottom to prevent said float from falling out of said body when the water level is low; and said float plug mating with the lower end of said water inlet so, when pushed up by buoyancy, said float plug seals said water inlet.

2. The self-watering and rotating Christmas tree stand of claim 1, wherein:

said mechanism to affix the tree to said water tank comprising a Y-shaped plate fixed to the bottom of the tree and a plurality of knob-grippers on the upper rim of said water tank; and said Y-shaped plate and said knob-grippers affix the tree firmly onto said water tank.

3. The self-watering and rotating Christmas tree stand of claim 2, wherein:

said plurality of knob-grippers further comprising a curved and studded plate at the end to come into contact and securely hold the trunk in upright position; and said curved and studded plate is suitably weighted to cause said curved and studded plate to be aligned along the axis of the tree truck when not in contact with the tree trunk.

4. The self-watering and rotating Christmas tree stand of claim 1, wherein:

said stationary support assembly further comprising a protective cover.

5. The self-watering and rotating Christmas tree stand of claim 1, wherein:

said electric drive motor is a gear motor.

6. The self-watering and rotating Christmas tree stand of claim 1, wherein:

said electric drive motor is a synchronous motor.

7. The self-watering and rotating Christmas tree stand of claim 1, wherein:

said stationary support assembly further comprising one gear or a plurality of gears between said electric drive motor and said tank gear integrated into the bottom of said water tank.

8. The self-watering and rotating Christmas tree stand of claim 1, wherein:

said stationary support assembly further comprising a switch box; and said switch box comprising two switches, one controlling the power supply to said electric drive motor and the other controlling the power supply to said power receptacle on said rotatable tank assembly.

9. The self-watering and rotating Christmas tree stand of claim 8, further comprising a remote control device, and wherein:

said switch box further comprising a remote control receiver to remotely control said two switches.

10. The self-watering and rotating Christmas tree stand of claim 1, wherein:

soluble fertilizers are added to the reservoir to fertilize the tree.

11. The self-watering and rotating Christmas tree stand of claim 1, wherein:

said stationary support assembly further comprising a drive gear between said electric drive motor and said tank gear integrated into the bottom of said water tank.

12. The self-watering and rotating Christmas tree stand of claim 1, wherein:

said stationary support assembly further comprising an idler gear or a plurality of idler gears to resist any imbalance torque.

13. A self-watering and rotating Christmas tree stand comprising:

a stationary support assembly, a rotatable tank assembly rotatably supported on said stationary support assembly, and an automatic watering system, with said stationary support assembly comprising a plurality of outwardly extending legs, a support framework, a support bearing to support said rotatable tank assembly, a sending-side slipping-ring connector to conduct electricity to said rotatable tank assembly, an electric drive motor, and a holding ring that retains said rotatable tank assembly to said stationary support assembly;

said rotatable tank assembly comprising a water tank, a mechanism to affix the tree to said water tank, a bearing race that matches said support bearing on said stationary support assembly and allows said rotatable tank assembly to rotate freely on said stationary support assembly, a receiving-side slipping-ring connector to receive electricity from said stationary support assembly, a power receptacle, electricity conducting cables connecting said receiving-side slipping-ring connector and said power receptacle, and a tank gear integrated into the bottom of said water tank; and said rotatable tank assembly comprising overflow tubes allowing excess water to be passed beyond the holding ring thereby reducing the possibility of water entering the stationary support assembly.

* * * * *